United States Patent [19]

Laureyns

[11] Patent Number: 4,998,473

[45] Date of Patent: Mar. 12, 1991

[54] RANDOM DATA LOTTO PRINTER AND METHOD FOR ITS MANUFACTURE

[76] Inventor: Rene Laureyns, 153 E. 32nd Street, New York, N.Y. 10016

[21] Appl. No.: 283,124

[22] Filed: Dec. 12, 1988

[51] Int. Cl.[5] ..... B41K 1/42

[52] U.S. Cl. ..... 101/333; 101/405; 101/407.1; 273/138 A; 273/269

[58] Field of Search ..... 101/485, 407.1, 405, 101/406, 333, 103, 426; 273/144 B, 138 A, 269, 138 R, 150, 58 F, 282, 284, 274, 11 R, 236–237, 123, 243, 240

[56] References Cited

U.S. PATENT DOCUMENTS

| | | | |
|---|---|---|---|
| 3,237,949 | 3/1966 | Chamberlin | 273/144 B |
| 3,703,293 | 11/1972 | Nekton | 101/103 |
| 3,843,133 | 10/1974 | Brown | 273/282 R |
| 4,444,394 | 4/1984 | Pasquine | 273/144 B |
| 4,498,671 | 2/1985 | Kostow | 273/144 B |
| 4,676,162 | 6/1987 | Phipps, Sr. et al. | 101/405 |
| 4,875,411 | 10/1989 | Turner | 102/333 |

FOREIGN PATENT DOCUMENTS

| | | | |
|---|---|---|---|
| 1094170 | 12/1960 | Fed. Rep. of Germany | 273/144 B |
| 2560057 | 8/1985 | France | 273/269 |

*Primary Examiner*—Eugene H. Eickholt

[57] ABSTRACT

A random date and lotto printer apparatus consisting of a grid having a plurality of recesses for receiving a number of balls in securement with random ones of some of recesses of the grid, a press member associated with each one of the plurality of recesses for being displaced downwardly when the random recesses have received the ball, a locator guide having a matrix of a plurality of apertures throughout in the matrix that essentially matingly match the recesses of the grid, and extensions on the press member for contacting a work surface of a work piece when the balls received in the recesses of the grid are retained in place by a plunger.

4 Claims, 4 Drawing Sheets

FIG. 6
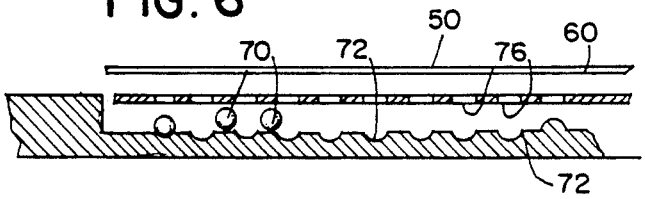
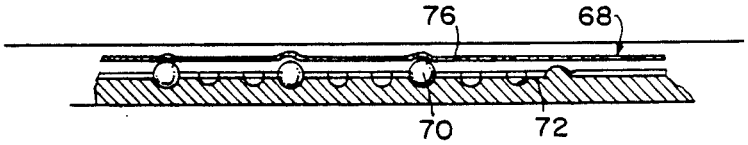
FIG. 7
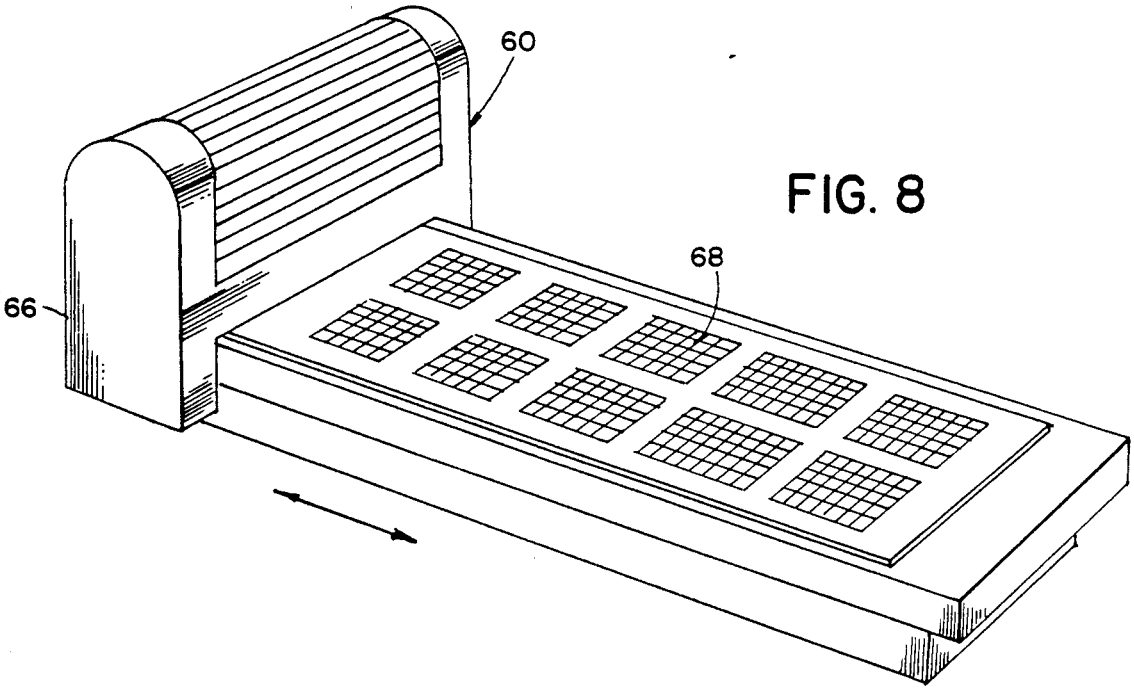
FIG. 8
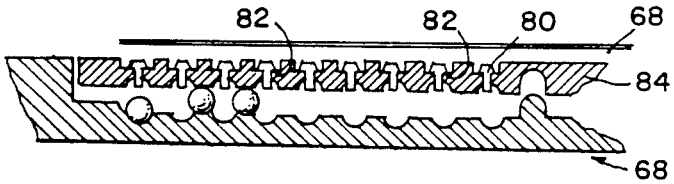
FIG. 9A
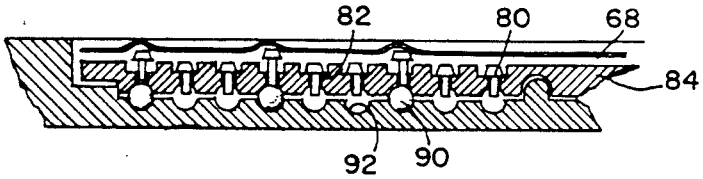
FIG. 9B

RANDOM DATA LOTTO PRINTER AND METHOD FOR ITS MANUFACTURE

BACKGROUND OF THE INVENTION

FIELD OF THE INVENTION

The invention relates to a random data lotto printer that consists of a grid, a number of balls, a number of marking members, a press apparatus, and an encasement member; and in which the balls may flow over the grid randomly selecting respective resting placements, and when so aligned, the marking members are aligned with the grid, and by the press means coax the balls against corresponding marking members as the marking members protrude from the encasement. More particularly the invention is directed to a random data and lotto printer apparatus consisting of a grid having a plurality of recesses for receiving a number of balls in securement with random ones of some of recesses of the grid, a press member associated with each one of the plurality of recesses for being displaced downwardly when certain random recesses have received ball. A locator guide having a matrix of a plurality of apertures throughout in the matrix that essentially matingly match the recesses of the grid, and extensions on the press member for contacting a work surface of a work piece when the balls received in the recesses of the grid are retained in place by a plunger.

A further feature of the invention includes use of a lotto card printer or imprinter which tends to resemble in some respects a standard credit card imprinter for high quality impressions, such as a NBS 810 imprinter manufactured by the Imprinter Division of National Business Systems, Inc., 171 Webster Road, Kitchener, Ontario N2C 2E7, and similiar models by addressograph Minneapolis, Minn. and is distinct in possessing at least two individually adjustable print rollers providing a high quality OCR (Optical Character Recognition) impression compatible with each and every pass of the movable head over the lotto card. Two or more standard sizes of lotto cards are acceptable. The lotto card imprinter of the invention is available with an option OCR Dater, showing time of issuance of the lotto card which has been imprinted, and is adaptable or constructed for single or double pass of the movable head over the lotto card.

The invention relates further to a device providing for the use of a game card having a plurality, such as ten (10) games on the card, and providing a rolling imprinter with a permanent ink roller thereof as more particularly described herein.

Description of the Prior Art

Various prior art game and play devices and the like, as well as apparatus and method of their construction in general, are found to be known, and exemplary of the U.S. prior art are the following:

| | |
|---|---|
| 1,475,975 | Van Nattan et al |
| 2,878,022 | Koci |
| 3,113,778 | Silverman |
| 3,204,345 | Buckner |
| 3,237,949 | Chamberlin |
| 3,240,496 | Reynertson |
| 3,345,071 | Nekton |
| 3,399,896 | Burnside |
| 3,405,943 | Marsh et al |
| 3,484,108 | Geiger |

-continued

| | |
|---|---|
| 3,638,948 | Smith |
| 3,703,293 | Nekton |
| 3,871,652 | Schreier |
| 4,274,638 | Jullien |
| 4,385,763 | Moscovich |
| 4,444,394 | Pasquine |
| 4,497,486 | Bennett |
| 4,498,671 | Kostow |
| 4,545,578 | Stagg, Jr. |
| 4,757,999 | Opresco |

Burnside discloses a matrix transformation game device; Kostow shows a lotto dice for use on a grid, a number of balls and a housing; Silverman, Pasquine, Bennett and Stagg, Jr. disclose devices for randomly selecting numbers. The Nekton patents and Reynertson show game boards with recording mechanisms; and Koci and Nujullien disclose a matrix electronic indication mechanism.

These patents or known prior uses teach and disclose various types of game or play devices of sorts and of various manufactures and the like as well as methods of their construction, but none of them whether taken singly or in combination disclose the specific details of the combination of the invention in such a way as to bear upon the claims of the present invention.

SUMMARY OF THE INVENTION

An object, advantage and feature of the invention is to provide a novel random data and lotto printer apparatus consisting of a grid having a plurality of recesses for receiving a number of balls in securement with random ones of some of recesses of the grid, a press member associated with each one of the plurality of recesses for being displaced downwardly when the randon recesses have received the ball, a locator guide having a matrix of a plurality of apertures throughout in the matrix that essentially matingly match the recesses of the grid, and extensions on the press member for contacting a work surface of a work piece when the balls received in the recesses of the grid are retained in place by a plunger.

A further object of the invention is to provide a lotto card printer or imprinter which tends to resemble in some respects a standard credit card imprinter for high quality impressions, such as the above NBS 810 imprinter, and is distinct in it possessing at least two individually adjustable print rollers providing a high quality OCR impression compatible with each and every pass of the movable head over the lotto card. Two or more standard sizes of lotto cards are acceptable, and the lotto card imprinter of the invention is available with an option OCR Dater, showing time of issuance of the lotto card which has been imprinted, and is adaptable or constructed for single or double pass of the movable head over the lotto card.

Another object of the invention is directed further to a device providing for a ten (10) game tab random pick lotto imprinter and construction details for the internal features of the random number printer of the invention, and the method of making and manufacturing the ten game tab random pick lotto printer.

Also an object of the invention is to provide a simple and direct method for the improved construction of a game, data, and lotto imprinter that is disassenbled and assembled with ease, as well as capable of being readily cleaned and repaired.

These together with other objects and advantages which will become subsequently apparent reside in the details of the process and operation thereof as more fully hereinafter is described and claimed, reference being had to the accompanying drawings forming a part hereof, wherein like numerals refer to like parts throughout.

DESCRIPTION OF THE SEVERAL VIEWS OF THE DRAWINGS

FIG. 6 shows details of the internal features of the printer such as is shown for example in FIG. 8, disposed in an open position, and FIG. 7 similarly shows these features in a compressed position for imprinting with the movable printing head in a device of FIG. 8, and embodying the concepts of the invention.

FIG. 8 presents a perpective view of a printer that provides a ten (10) game tab random pick lotto imprinter according to an embodiment of the invention, and FIGS. 9A and 9B show details of the internal features of the random number printer of the invention.

DESCRIPTION OF A PREFERRED EMBODIMENT OF THE INVENTION

Figure 1:
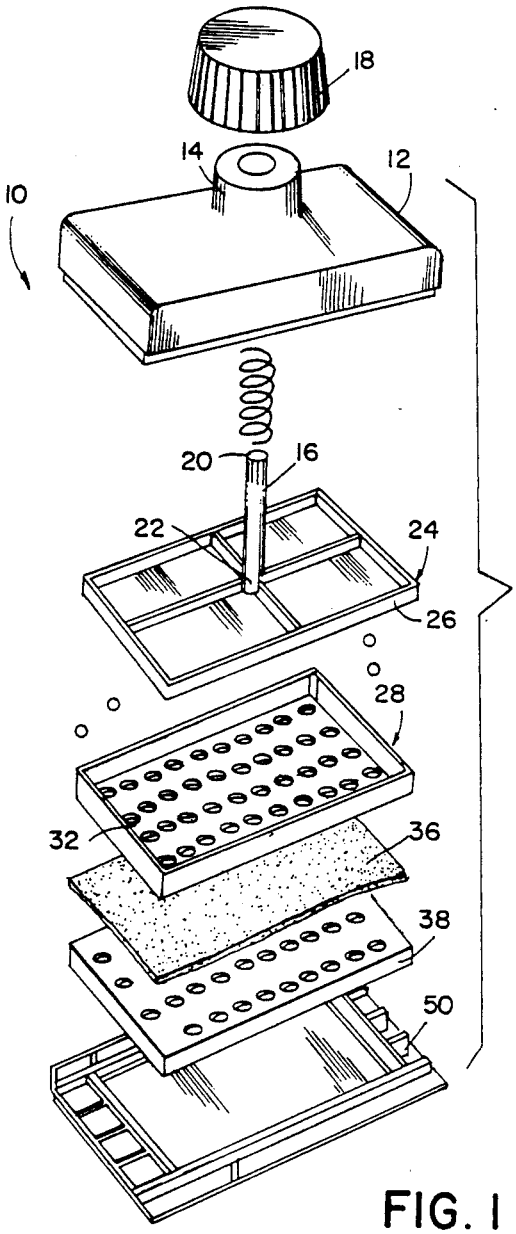
FIG. 1 is an perspective and exploded view of a random data and lotto printer apparatus and illustrating a typical construction of the lotto printer according to a preferred embodiment and best mode of the present invention.
Figure 2:
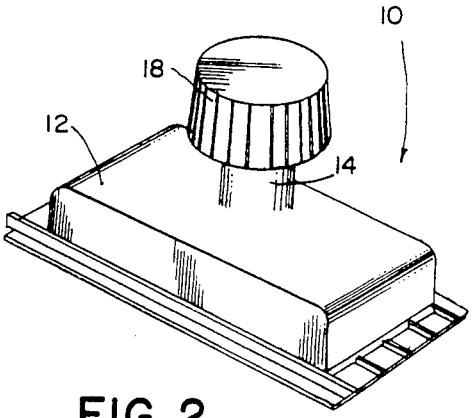
FIG. 2 is an assembled perspective view of the random pick lotto printer apparauts of FIG. 1.

Referring now to the drawings there is shown in FIGS. 1 and 2 a random data and pick lotto printer 10 having a body cover 12 formed to provide a central protuberance 14 supporting a sliding shaft or rod 16 with a plunger knob 18 on the upper terminal end 20 of the rod 16. The lower end 22 of the rod 16 is connected to a plate or plunger 24 that has edges 26 defined and dimensioned to fit within a grid or ball guide 28.

A grid or ball guide 28 has a plurality of recesses 30 for receiving a number of stainless steel balls 34 in securement with random ones of some of the recesses 30 of the guide 28. A print or sheet press member 36 is associated with the plurality of recesses 32 for being displaced downwardly when random ones of the recesses 32 have received the ball 34. A locator guide 38 has a matrix of a plurality of apertures 40 throughout in the matrix that essentially matingly match the recesses 32 of the guide 28.

Figure 3:
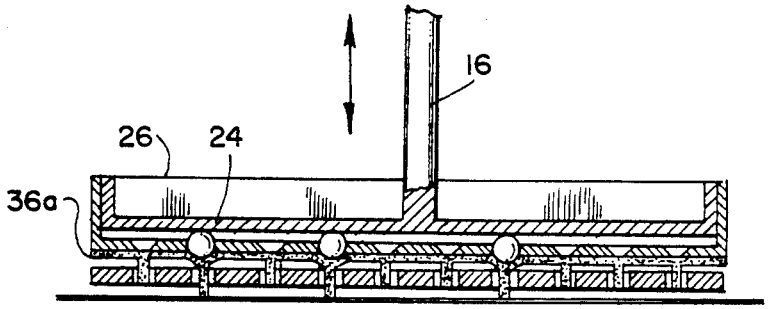
FIGS. 3 and 4 are sectional view that show imprint and retracted positions of the the random pick lotto printer.
Figure 4:
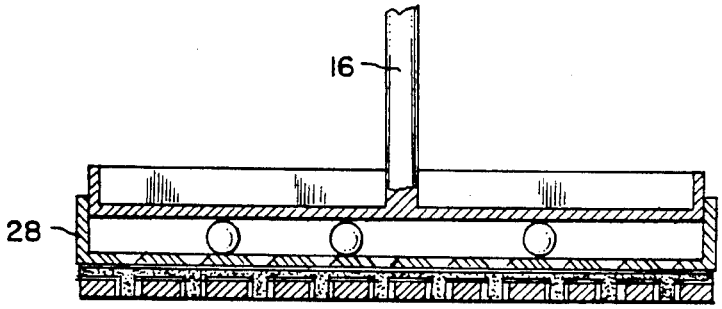
Figure 5:
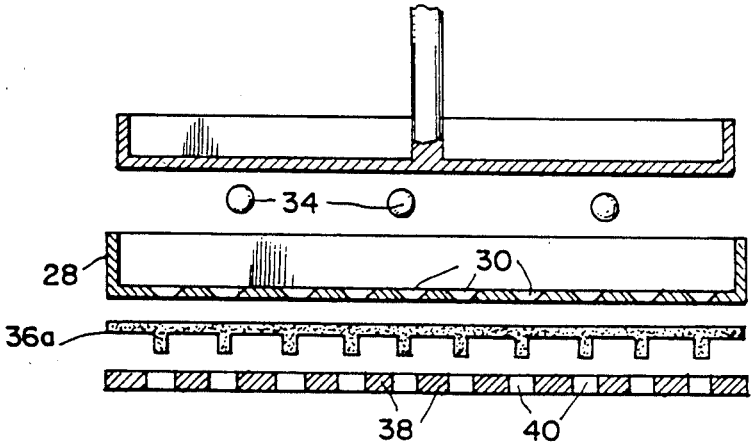
FIG. 5 shows an exploded sectional view of the random pick lotto printer.

In FIGS. 3–5 another embodiment is shown so that a molded press sheet member **36*a* posesses permanent inked protuberances or extensions 42 on its underside, and the extensions 42 on the press member 36*a* contact a work surface 50 of a work piece when the balls received in the recesses of the guide 28 and are retained in place by a plunger, as shown. This describes the embodiments of FIGS. 1–5**.

Another arrangement is shown in FIGS. 6–8 and FIGS. 8–10 in which some of the operative members are cooperatively arranged but are in inverted order of orientation. A further feature of the invention includes use of a lotto card printer or imprinter 60 which resembles in some respects the standard credit card imprinter (not shown) for high quality impressions, such as a NBS 810 imprinter manufactured by the Imprinter Division of National Business Systems, Inc., and is distinct in possessing at least two individually adjustable print rollers 62, 64 shown in FIG. 10 for providing a high quality OCR (Optical Character Recognition) impression compatible with each and every pass of the movable head 66 over the lotto card 68. Two or more standard sizes of lotto cards are acceptable (not shown). The lotto card imprinter 60 of the invention is available with a conventional OCR Dater, for showing time of issuance of the lotto card 68 which has been imprinted, and is adaptable or constructed for single or double pass of the movable head 66 over the lotto card 68. FIGS. 6–7 show an arrangement for rolling balls 70 in an open space allowing random selection of a recess 72 which are retained in place by a imprint plate 74 with holes 76 and the step or condition of retention of the balls 70 is indicated in FIG. 7. When compressed, the steel balls 70 are in position on the body assembly to push through holes 76 and imprint there presence on the lotto card 68.

Figure 10:
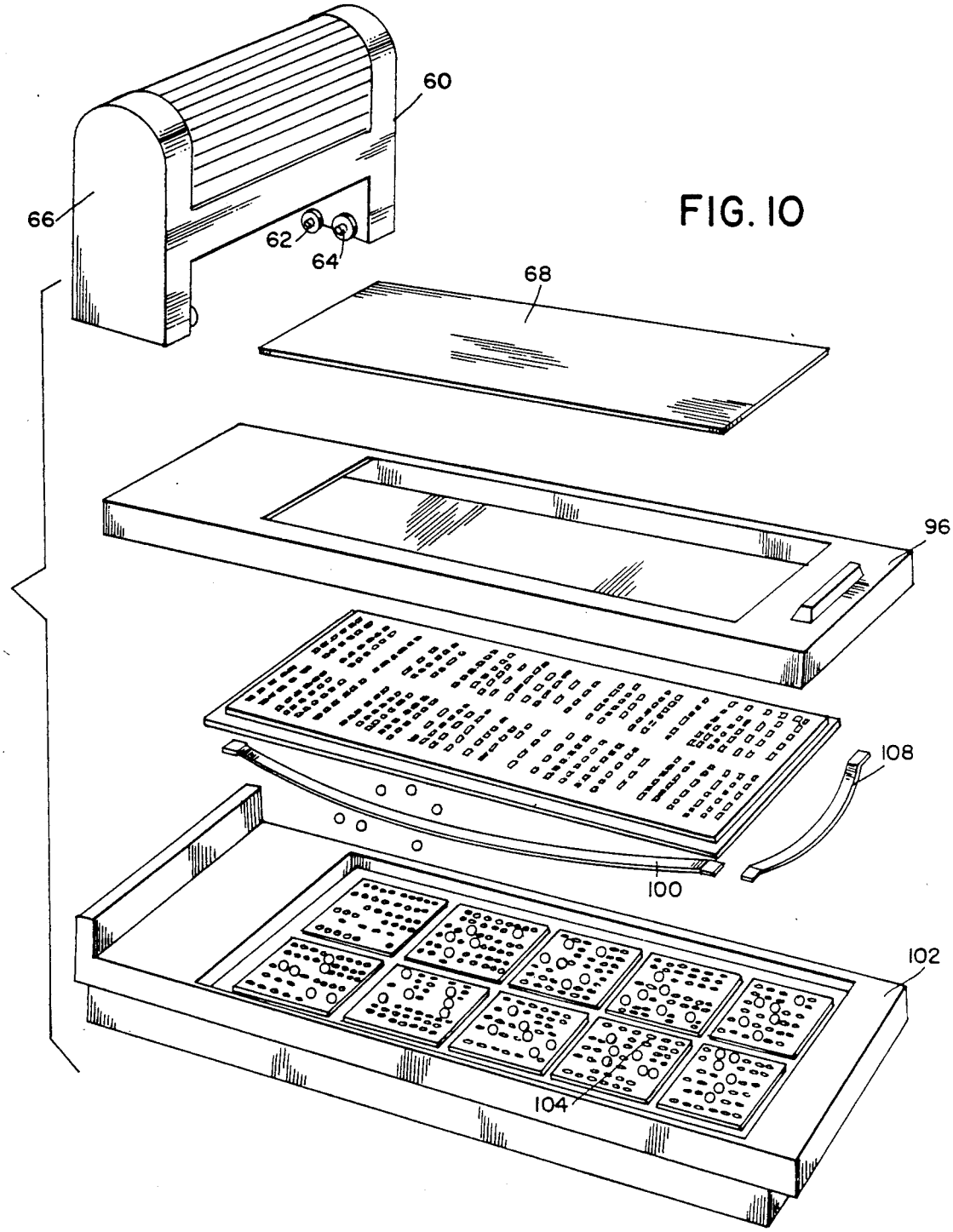
FIG. 10 is an exploded perspective view of the internal components of the ten (10) game tab random pick lotto imprinter of FIG. 8.

Another preferred embodiment is shown in FIGS. 9A and 9B that provide also upward printing of the data on the card 68. An set of imprint tabs 80 are disposed at rest on shoulders 82 of the imprint plate 84 and when in the open position of FIG. 9A, the balls 90 roll about for random selection into recesses 92. When the card 68 is compressed into engagement with the imprinter plate 84 shown in FIG. 9B, the imprint tabs 80 contact steel balls 90 if present in the recesses 92, and the imprint tabs 80 pop generally upwardly to contact creation of an imprint surface to mark off on the playing card 68 the presence of the balls 90 when the card 68 contacts the rollers 62, 64 of the printer. A body cover 96 shown in FIG. 10 provides retaining the lotto card 68 in place when cooperating with a spring clips 100 which are received in the body assembly 102 with the random pick ball guide recessed panel 104.

The apparatus of the random pick lotto printer 10 of the invention may be so constructed and arranged in its component parts that it may be assembled as a kit or in kit form.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed and desired to be secured by Letters patent is:

1. A random data and lotto printer apparatus comprising:

a first grid having a plurality of holes, said first grid having an upstanding wall means surrounding said plurality of holes, a flat plate means adapted and constructed to reciprocatingly slide within said wall means, said flat plate means, said wall means and said first grid together defining a variable volume space, said variable volume space containing a plurality of balls the diameter of which being larger than the said holes of said grid, said grid and said balls being relatively dimensioned whereby a portion of the said balls projects through the holes in which they may reside, a moist inked imprint pad external of said variable space and having one side in touching confrontation with said first grid, said moist inked pad on its other side having a plurality of integral extending members, a second grid having a plurality of holes axially aligned with the plurality of holes in said first grid and having the integral extending members extending therethrough and the integral extending members being in elongated dimension substantially equal to the dimension of the second grid, retaining and aligning means for holding a to-be-printed surface means against the second grid whereby the apparatus may selectively imprint the surface means in response to the position of the balls on the first grid in said variable space when said plate means is reciprocatingly slid towards the first grid in impingement of said balls thereby selectively thrusting the integral extending members in the direction of the to-be-printed surface.

2. The apparatus of claim 1 wherein the flat plate means has a handle extending externally opposite of variable space.

3. The apparatus of claim 2 wherein the first grid, the moist inked pad and the second grid together are positioned in a housing and said handle projects through an opening in said housing longitudinally with said apparatus.

4. The apparatus of claim 3 wherein spring means is positioned to urge said flat plate away from impingement of said balls.

* * * * *